US007858575B2

(12) United States Patent
De Block

(10) Patent No.: US 7,858,575 B2
(45) Date of Patent: Dec. 28, 2010

(54) FABRIC SOFTENING COMPOSITIONS COMPRISING GLYCEROL TRICAPRYLATE HAVING IMPROVED STABILITY UPON STORAGE

(75) Inventor: Franciscus Joseph Madeleine De Block, Merchtem (BE)

(73) Assignee: The Procter & Gamble Company, Cincinnati, OH (US)

( * ) Notice: Subject to any disclaimer, the term of this patent is extended or adjusted under 35 U.S.C. 154(b) by 295 days.

(21) Appl. No.: 12/255,928

(22) Filed: Oct. 22, 2008

(65) Prior Publication Data

US 2009/0111728 A1 Apr. 30, 2009

(30) Foreign Application Priority Data

Oct. 26, 2007 (EP) ..... 07119405

(51) Int. Cl.
*C11D 1/62* (2006.01)
*C11D 3/30* (2006.01)

(52) U.S. Cl. ..... 510/521; 510/276; 510/287; 510/308; 510/327; 510/329; 510/330; 510/353; 510/394; 510/437; 510/480; 510/504; 510/515

(58) Field of Classification Search ..... 510/276, 510/287, 308, 327, 329, 330, 353, 394, 437, 510/480, 504, 515, 521
See application file for complete search history.

(56) References Cited

U.S. PATENT DOCUMENTS

| | | | | |
|---|---|---|---|---|
| 4,386,000 | A | 5/1983 | Turner et al. | |
| 4,840,738 | A | 6/1989 | Hardy et al. | |
| 6,093,691 | A | 7/2000 | Sivik et al. | |
| 2002/0010104 | A1 | 1/2002 | Ewbank et al. | |
| 2005/0070457 | A1 | 3/2005 | Duval et al. | |
| 2008/0014167 | A1 * | 1/2008 | Bitter et al. | 424/70.14 |

FOREIGN PATENT DOCUMENTS

| | | | |
|---|---|---|---|
| WO | WO 95/29980 | A | 11/1995 |
| WO | WO 97/17419 | A1 | 5/1997 |

OTHER PUBLICATIONS

International Search Report Dated Mar. 19, 2009—5 pgs.

* cited by examiner

*Primary Examiner*—Charles I Boyer
(74) *Attorney, Agent, or Firm*—Mark A Charles; David V Upite; Melissa G Krasovec

(57) ABSTRACT

The present invention relates to fabric softening compositions providing improved stability upon storage as well as improved resistance to shear.

5 Claims, No Drawings

FABRIC SOFTENING COMPOSITIONS COMPRISING GLYCEROL TRICAPRYLATE HAVING IMPROVED STABILITY UPON STORAGE

FIELD OF THE INVENTION

The present invention relates to fabric softening compositions providing improved product stability upon prolonged storage at high temperatures as well as improved resistance to shear.

BACKGROUND OF THE INVENTION

Conventional liquid fabric softening compositions are typically in the form of dispersed colloidal particles of the fabric softening compound. Fabric softening compositions formed from dispersed colloidal particles generally have complex and unstable structures. Because of this inherent instability, many problems are associated with conventional fabric softening compositions such as product or viscosity instability, especially after long time storage, such that the corresponding compositions become unpourable and have inadequate dispensing and dissolving characteristics in rinse water. In addition, at all steps of the fabric softening composition manufacturing and transportation chain, such composition may be subjected to unwanted shear and shaking which may prematurely affect product stability of the products. This may especially happen when the corresponding composition is produced upon high-shear mixing or when the finished composition is transported or stored under extreme conditions such as in uneven regions. This may pose problems to the user upon usage or may affect retailers when placing products on the shelves, without mentioning any associated loss of performance for the softening products.

The afore-mentioned problems are known to be further exacerbated when the softening composition is in concentrated form, when a perfume is further incorporated, or when the composition is subjected to high temperatures. Moreover, recent liquid fabric softening compositions typically make use of quaternized ester-amines which are known to be rapidly biodegradable. Unfortunately, those softening actives are more subject to hydrolysis than conventional softening agents and hence can encounter hydrolytic stability problems upon prolonged shelf storage.

Partial solutions to these drawbacks have been provided with for example in WO 97/17419 which discloses fabric conditioning compositions comprising a softening agent, a perfume and a diester for achieving reduced instability of the softener compositions caused by perfumes and extremes conditions. U.S. Pat. No. 4,840,738 and U.S. Pat. No. 4,386,000 disclose fabric softening compositions claimed to possess desirable product stability and viscosity characteristics at both normal and elevated temperatures.

Notwithstanding the benefits and advantages associated with the disclosed fabric softening compositions, there is still a need for concentrated fabric softening compositions having improved resistance to shear as well as excellent stability and viscosity characteristics upon prolonged storage, and which overcome the drawbacks associated with the know softening compositions.

It has now been found that the above objective can be met by providing a softening composition according to the present invention.

Advantageously, the compositions according to the present invention greatly facilitate the formulation of highly concentrated and compact compositions. It is a further advantage that the compositions according to the present invention provide excellent dispensability and dispersibility properties.

Other advantages and more specific properties of the method according to the present invention will be clear after reading the following description of the invention.

SUMMARY OF THE INVENTION

The present invention relates to fabric softening compositions which provide improved product stability upon prolonged storage. Said compositions comprise a fabric softening active, a hydrophobic ester and a chelant, wherein the hydrophobic ester has a Clog P of greater than 4, preferably selected from the group consisting of glycerol tricaprylate, isopropyl caprylate, ethyl hexyl caprylate, isopropyl myristate, dioctyl adipate, glycol diesters of C8-C22 fatty acids or mixtures thereof, and wherein the chelant is preferably selected from the group consisting of the penta sodium salt of Diethylene Triamine Pentaacetic acid (DTPA), the mono sodium salt of 1-HydroxyEthane-1,1-DiPhosphonic acid (HEDP), ethylenediaminetetraacetic acid (EDTA), S,S-Ethylenediamine disuccinic acid (EDDS), Catechol 2,4-disulfonate (commercially available as Tiron®), diethylenetriamine-penta methylene phosphoric acid (DTPMP), dipicolinic acid and salts and/or acids thereof, and mixtures thereof. According to the present invention, said fabric softening composition is substantially free of nonionic surfactant.

In a preferred execution, the hydrophobic ester is glycerol tricaprylate and the chelant is the penta sodium salt of Diethylene Triamine Pentaacetic acid (DTPA).

In another embodiment, the present invention relates to a process of manufacturing a fabric softening composition comprising a fabric softening active.

DETAILED DESCRIPTION OF THE INVENTION

Definitions

"Clog P" represents the logarithm of the octanol/water partition coefficient. By "shear", it is meant to represent herein any form of shearing effect applied to the compositions that may result from actions such as pumping, mixing, manufacturing, transportation, packing, shipping, and combinations thereof.

Fabric Softener Active

The composition according to the present invention comprises as one essential ingredient a fabric softener active (FSA). Suitable fabric softener actives for use herein include, but are not limited to diester quaternary ammonium compounds, dialkyl quaternary ammonium compounds, imidazolinium quaternary compounds, cationic starch, sucrose ester-based fabric care materials, cationic and aminosilicones, and mixtures thereof. Typically, the compositions according to the present invention comprise from 1% to 25%, preferably of from 2% to 20%, more preferably of from 4% to 16%, and most preferably from 6% to 14% by weight of the total composition of said fabric softener active, or mixtures thereof.

Diester Quaternary Ammonium (DEQA) Compounds

The diester quaternary ammonium compounds suitable as a fabric softening active in the present compositions include compounds of the formula:

$$\{R_{4-m}—N^+—[(CH_2)_n—Y—R^1]_m\}X^-$$

wherein each R substituent is either hydrogen, a short chain $C_1$-$C_6$, preferably $C_1$-$C_3$ alkyl e.g., methyl (most preferred), ethyl, propyl and the like, poly ($C_{2-3}$ alkoxy), preferably polyethoxy, group, benzyl, or mixtures thereof; each m is 2 or 3; each n is from 1 to about 4, preferably 2; each Y is —O—(O)C— or —C(O)—O and it is acceptable for each Y to be the same or different; the sum of carbons in each $R^1$, is $C_{11}$-$C_{21}$, preferably $C_{13}$-$C_{19}$, with each $R^1$ being a hydrocarbyl, or substituted hydrocarbyl group; it is acceptable for $R^1$ to be unsaturated or saturated and branched or linear and preferably it is linear; it is acceptable for each $R^1$ to be the same or different and preferably these are the same; and $X^-$ can be any softener-compatible anion, preferably, chloride, bromide, methylsulfate, ethylsulfate, sulfate, phosphate, and nitrate, more preferably chloride or methyl sulfate. Preferred diester quaternary ammonium compounds are typically made by reacting alkanolamines such as MDEA (methyldiethanolamine) with fatty acids. Some materials that typically result from such reactions include N,N-di(acyl-oxyethyl)-N,N-dimethylammonium chloride or N,N-di(acyl-oxyethyl)-N,N-dimethylammonium methylsulfate wherein the acyl group is derived from animal fats such as tallow, or vegetable oils such as palm or unsaturated, and polyunsaturated, fatty acids, e.g. oleic acid, and/or partially hydrogenated fatty acids, derived from vegetable oils and/or partially hydrogenated vegetable oils, such as, canola oil, safflower oil, peanut oil, sunflower oil, corn oil, soybean oil, tall oil, rice bran oil, etc. Non-limiting examples of suitable fatty acids are listed in U.S. Pat. No. 5,759,990 at column 4, lines 45-66. Non-limiting examples of preferred diester quats for the present invention include N,N-di(tallowoyloxyethyl)-N,N-dimethylammonium chloride (available from Akzo under the trade name Armosoft® DEQ) and N,N-di(canola-oyloxyethyl)-N,N-dimethylammonium chloride (available from Degussa under the trade name Adogen® CDMC).

Dialkyl Quaternary Ammonium Compounds (DQA)

The dialkyl quaternary ammonium compounds suitable as a fabric softening active in the present compositions include compounds of the formula:

$$\{R_{4-m}—N^+—[(CH_2)_n—Y—R^1]_m\}X^-$$

wherein each R substituent is either hydrogen, a short chain $C_1$-$C_6$, preferably $C_1$-$C_3$ alkyl e.g., methyl (most preferred), ethyl, propyl and the like, poly ($C_{2-3}$ alkoxy), preferably polyethoxy, group, benzyl, or mixtures thereof; each m is 2 or 3; each n is from 1 to about 4, preferably 2; each Y is $CH_2$, or —NR—C(O)—, or —C(O)—NR— and it is acceptable for each Y to be the same or different; the sum of carbons in each $R^1$, minus (n+1) when Y is $CH_2$, is $C_{12}$-$C_{22}$, preferably $C_{14}$-$C_{20}$, with each $R^1$ being a hydrocarbyl, or substituted hydrocarbyl group; it is acceptable for $R^1$ to be unsaturated or saturated and branched or linear and preferably it is linear; it is acceptable for each $R^1$ to be the same or different and preferably these are the same; and $X^-$ can be any softener-compatible anion, preferably, chloride, bromide, methylsulfate, ethylsulfate, sulfate, phosphate, and nitrate, more preferably chloride or methyl sulfate.

Imidazolinium Quaternary Compounds

In another embodiment, the fabric softening active may comprise a imidazolinium quaternary compound of the following formula:

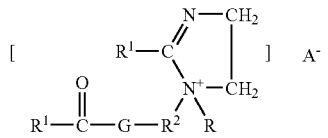

wherein each R, $R^1$, and $A^-$ have the definitions given above; each $R^2$ is a $C_{1-6}$ alkylene group, preferably an ethylene group; and G is an oxygen atom or an —NR— group.

Examples of imidazolinium quaternary compounds include: 1-methyl-1-tallowylamidoethyl-2-oleylimidazolinium methylsulfate and 1-methyl-1-oleylamidoethyl-2-oleylimidazolinium methylsulfate, wherein $R^1$ is an acyclic aliphatic $C_{15}$-$C_{17}$ hydrocarbon group, $R^2$ is an ethylene group, G is a NH group, $R^5$ is a methyl group and $A^-$ is a methyl sulfate anion, available commercially from Degussa under the trade names Varisoft® 475 and Varisoft® 3690, respectively.

Cationic Starch

In another aspect, the present invention provides a cationic starch as a fabric softening active. The term "cationic starch" is used herein in the broadest sense. In one aspect of the invention, cationic starch refers to starch that has been chemically modified to provide the starch with a net positive charge in aqueous solution at pH 3. This chemical modification includes, but is not limited to, the addition of amino and/or ammonium group(s) into the starch molecules. Non-limiting examples of these ammonium groups may include substituents such as trimethylhydroxypropyl ammonium chloride, dimethylstearylhydroxypropyl ammonium chloride, or dimethyldodecylhydroxypropyl ammonium chloride. See Solarek, D. B., *Cationic Starches in Modified Starches: Properties and Uses*, Wurzburg, O. B., Ed., CRC Press, Inc., Boca Raton, Fla. 1986, pp 113-125.

In one embodiment, the compositions of the present invention generally comprise cationic starch at a level of from about 0.1% to about 7%, alternatively from about 0.1% to about 5%, alternatively from about 0.3% to about 3%, alternatively from about 0.5% to about 2%, alternatively from about 0.01% to about 5%, and alternatively from about 0.3% to about 2%, by weight of the composition. Cationic starch is described in U.S. Pat. Pub. 2004/0204337 A1, published Oct. 14, 2004, to Corona et al., at paragraphs 16-32.

Sucrose Ester-Based Fabric Care Materials

In another embodiment, the compositions of the present invention may comprise a sucrose ester-based fabric care material as a fabric softening active. A sucrose ester may be composed of a sucrose moiety having one or more of its hydroxyl groups esterified. Sucrose is a disaccharide having the following formula:

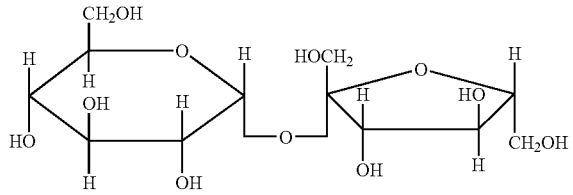

Alternatively, the sucrose molecule can be represented by the formula: $M(OH)_8$, wherein M is the disaccharide backbone and there are total of 8 hydroxyl groups in the molecule. Thus, sucrose ester can be represented by the following formula:

$$M(OH)_{8-x}(OC(O)R^1)_x$$

wherein x of the hydroxyl groups are esterified and (8-x) hydroxyl groups remain unchanged; x is an integer selected from 1 to 8, or from 2 to 8, or from 3 to 8, or from 4 to 8; and $R^1$ mioeties are independently selected from $C_1$-$C_{22}$ alkyl or $C_1$-$C_{30}$ alkoxy, linear or branched, cyclic or acyclic, saturated or unsaturated, substituted or unsubstituted. In one embodiment, the $R^1$ moieties comprise linear alkyl or alkoxy moieties having independently selected and varying chain length. For example, $R^1$ may comprise a mixture of linear alkyl or alkoxy moieties wherein greater than 20% of the linear chains are $C_{18}$, or greater than 50% of the linear chains are $C_{18}$, or greater than 80% of the linear chains are $C_{18}$. In another embodiment, the $R^1$ moieties comprise a mixture of saturate and unsaturated alkyl or alkoxy moieties; the degree of unsaturation can be measured by "Iodine Value" (hereinafter referred as "IV", as measured by the standard AOCS method). The IV of the sucrose esters suitable for use herein ranges from 1 to 150, or from 2 to 100, or from 5 to 85. The $R^1$ moieties may be hydrogenated to reduce the degree of unsaturation. In a further embodiment, the unsaturated $R^1$ moieties may comprise a mixture of "cis" and "trans" forms about the unsaturated sites. The "cis"/"trans" ratios may range from 1:1 to 50:1, or from 2:1 to 40:1, or from 3:1 to 30:1, or from 4:1 to 20:1. In another embodiment, the composition comprises an olyhydroxy material or sugar derivative. Polyhydroxy amide structures as disclosed in U.S. Pat. No. 5,534,197 by Scheibel et al. and U.S. Pat. No. 5,512,699 by Connor et al.; Pentaerythritol compounds and derivatives as disclosed in U.S. Pat. No. 6,294,516; cyclic polyols and/or reduced saccharides as disclosed in U.S. Pat. No. 6,410,501.

Cationic and Aminosilicones.

In still another embodiment, the compositions of the present invention may comprise a cationic or amino functionalized silicones as a fabric softening active. Typical examples of cationic or amino functionalized silicones are those described in U.S. Pat. Appl. Publ. No. 2004/036319 and U.S. Pat. Publ. No. 2005/0026793 A1, Feb. 3, 2005, at paragraphs 137-162. In one embodiment, the aminosilicones can be linear or branched structured aminosilicone polymers comprised of the following base units:

$$(R^1R^2R^3SiO_{1/2})_p(R^4R^4SiO_{2/2})_m[R^4Si(L\text{-}NR^5R^6)O_{2/2}]_a[Si(K\text{—}NR^7R^8)O_{3/2}]_b[R^4SiO_{3/2}]_c$$

wherein $R^1$, $R^2$, $R^3$ and R can independently be (1) $C_1$-$C_{22}$ linear or branched, substituted or unsubstituted hydrocarbyl moiety, or (2) —O—$R^{11}$, —O—$R^{12}$, —O—$R^{13}$, and —O—$R^{14}$, where $R^{11}$, $R^{12}$, $R^{13}$, and $R^{14}$ are H or $C_1$-$C_{22}$ linear or branched, substituted or unsubstituted hydrocarbyl moiety. The nomenclature "$SiO_{n/2}$" means the ratio of oxygen atoms to silicon atoms, i.e., $SiO_{1/2}$ means one oxygen atom is shared between two silicon atoms. Likewise, $SiO_{2/2}$ means two oxygen atoms are shared between two silicon atoms and, $SiO_{3/2}$ means three oxygen atoms are shared between two silicon atoms.

L and K can independently be $C_1$-$C_{22}$ linear or branched, substituted or unsubstituted hydrocarbyl moiety. Preferably L and K are independently $C_1$-$C_{12}$ linear or branched, substituted or unsubstituted hydrocarbyl moiety. More preferably L and K are independently $C_1$-$C_4$ linear or branched, substituted or unsubstituted hydrocarbyl moiety. Most preferably L and K are independently methylene, ethylene, propylene, 2-methylpropylene, butylene, octadecylene, or 3-(2,2',6,6'-tetramethyl-4-oxy-piperidyl)propyl.

$R^5$, $R^6$, $R^7$ and $R^8$ can independently be H or $C_1$-$C_{22}$ linear or branched, substituted or unsubstituted hydrocarbyl moiety, including nitrogen and other heteroatom containing substituent. Preferably $R^5$, $R^6$, $R^7$ and $R^8$ are independently H or $C_1$-$C_{12}$ linear or branched, substituted or unsubstituted, alkyl or aryl hydrocarbyl moiety, including nitrogen containing substituent and oxygen containing substituent. Most preferably, $R^5$, $R^6$, $R^7$ and $R^8$ are independently H, phenyl, cyclohexyl, phenyl, 2-aminoethyl, 2-(N-2-aminoethyl)aminoethyl, 2-[N-2-(N-2-aminoethyl)aminoethyl]aminoethyl, 2-(N-phenyl)aminoethyl, 2-(N-cyclohexyl)aminoethyl, polyethyleneoxide, polypropyleneoxide, polyethyleneoxide-co-polypropyleneoxide, or polyethyleneoxide-co-polypropyleneoxide-co-polyethyleneamine.

Adjunct Fabric Softening Actives

The fabric softening compositions of the present invention may comprise adjunct fabric softening actives, as optional ingredients. These active may include one or more of the following: silicones, including those described in U.S. Pat. Pub. No. 2002/0077265 A1, to Buzzacarini et al., published Jun. 20, 2002 at paragraphs 51-57; clays as described in U.S. Pat. Pub. No. 2004/0142841 A1, published Jul. 22, 2004, to de Buzzacarini et al., from paragraphs 74-99; fats and/or fatty acids as described in U.S. Pat. Appl. Pub. No. 2006/0122087 A1; polyhydroxy amide structures as described in U.S. Pat. No. 5,534,197 by Scheibel et al. and U.S. Pat. No. 5,512,699 by Connor et al.; Pentaerythritol compounds and derivatives thereof as disclosed in U.S. Pat. No. 6,294,516; and cyclic polyols and/or reduced saccharides as disclosed in U.S. Pat. No. 6,410,501.

In one embodiment, the composition of the present invention comprises from 0.001% to 10% of an adjunct fabric softening compound. In another embodiment, the compositions are free or essentially free of one the aforementioned adjunct fabric softening actives.

Hydrophobic Ester

The composition according to the present invention comprises, as another essential ingredient, a hydrophobic ester having a Clog P of greater than 4.

Suitable hydrophobic esters for use herein comprise esters of monobasic or dioic acids and monohydric or poly alcohols. Suitable acids comprise monobasic or dioic acids with having a non cyclic aliphatic hydrocarbon chain comprising from $C_4$-$C_{26}$ carbon atoms, more preferably from $C_6$-$C_{22}$ carbon atoms, even more preferably from $C_6$-$C_{18}$, most preferably from $C_8$-$C_{12}$ carbon atoms. Suitable acids for use in the present invention may have any level of unsaturation, and may comprise branched or linear carbon chains. According to a preferred embodiment, the acids for use herein are selected from those having linear and saturated aliphatic carbon chains. Examples of suitable acids include, but are not limited to butyric acid, caproic acid, caprylic acid, capric acid, lauric acid, myristic acid, glutaric acid, succinic acid, adipic acid, and mixtures thereof. In a more preferred embodiment, hydrophobic esters for use in the present invention are selected from esters of fatty acid with alcohols having from 1 to 10, more preferably from 2 to 8, even more preferably from 3 to 8, most preferably from 4 to 6 carbon atoms. Examples of suitable alcohols include, but are not limited to methyl alcohol, ethyl alcohol, propyl alcohol, isopropyl alcohol, butyl alcohol, isobutyl alcohol, tertiobutyl alcohol, pentyl alcohol, hexyl alcohol, heptyl alcohol, octyl alcohol, ethyl hexyl alcohol, monoglyceryl alcohols, diglyceryl alcohols, triglyceryl alcohols and mixtures thereof.

Still according to a preferred execution of the present invention, the hydrophobic esters of fatty acid for use herein are selected from esters of $C_6$-$C_{22}$ non cyclic hydrocarbon fatty acids with alcohols having from 1 to 10 carbon atoms, preferably from esters of $C_8$-$C_{16}$ non cyclic hydrocarbon fatty acids with alcohols having from 2 to 8 carbon atoms. More preferably, the hydrophobic esters for use herein are selected from esters of glycerol, preferably from mono-, di-, or tri-esters of glycerol, and combinations thereof. Even more preferably, the hydrophobic esters for use herein are selected from monoesters of glycerol, triesters of glycerol, and combinations thereof. In an even more preferred execution of the present invention, the hydrophobic esters for use herein are selected from fatty acid esters of glycerol, preferably from mono-, di-, or tri-fatty acid esters of glycerol, and combinations thereof. In a very preferred embodiment of the present invention, the hydrophobic esters for use herein are selected from the group consisting of glycerol tricaprylate, isopropyl caprylate, ethyl hexyl caprylate, isopropyl myristate, dioctyl adipate, glycol diesters of C8-C22 fatty acids and mixtures thereof. According to the most preferred execution of the present invention, the hydrophobic ester for use herein is selected to be glycerol tricaprylate.

It is an essential feature of the present invention that the hydrophobic esters for use herein have a Clog P of greater than 4, preferably greater than 5, preferably greater than 6, more preferably greater than 7, and most preferably greater than 8. More preferably, the hydrophobic esters have a Clog P comprised between 7 and 10, preferably between 9 and 10.

According to a preferred embodiment of the present invention, the hydrophobic esters have a low melting point, typically lower then 25° C., preferably lower than 0° C., more preferably lower than −15° C., and most preferably lower than −20° C. Without being bound by any theory, it is believed that the presence of hydrophobic esters have a low melting point improves the dispersibility profile of the softening active.

Typically, the compositions according to the present invention comprise from 0.01% to 10%, preferably of from 0.05% to 5%, more preferably of from 0.05% to 2% and most preferably from 0.1% to 0.5% by weight of the total composition of said hydrophobic ester, or mixtures thereof.

Chelants

The composition according to the present invention comprises, as another essential ingredient, a chelant.

Chelants are distinguished from common builders such as citrate in that they preferentially bind transition metals.

In a preferred execution, the chelant is selected from the group consisting of the penta sodium salt of Diethylene Triamine Pentaacetic acid (DTPA), the mono sodium salt of 1-HydroxyEthane-1,1-DiPhosphonic acid (HEDP), ethylenediaminetetraacetic acid (EDTA), S,S-Ethylenediamine disuccinic acid (EDDS), Catechol 2,4-disulfonate (commercially available as Tiron®), diethylenetriamine-penta methylene phosphoric acid (DTPMP), dipicolinic acid and salts and/or acids thereof, and mixtures thereof. Further non-limiting examples of suitable chelating agents and levels of use are described in U.S. Pat. Nos. 3,812,044; 4,704,233; 5,292,446; 5,445,747; 5,531,915; 5,545,352; 5,576,282; 5,641,739; 5,703,031; 5,705,464; 5,710,115; 5,712,242; 5,721,205; 5,28,671; 5,747,440; 5,780,419; 5,789,409; 5,929,010; 5,929,018; 5,958,866; 5,965,514; 5,972,038; 6,162,021; and 6,503,876.

According to the most preferred execution of the present invention, the chelant for use herein is selected to be the penta sodium salt of Diethylene Triamine Pentaacetic acid (DTPA).

Typically, the compositions according to the present invention comprise from 0.001% to 5%, preferably from 0.005% to 0.02% by weight of the total composition of said chelant, or mixtures thereof.

Optional Ingredients

According to another aspect of the present invention, the fabric softening compositions may comprise one or more of the following optional ingredients: perfumes, dispersing agents, stabilizers, pH control agents, colorants, brighteners, dyes, odor control agent, pro-perfumes, cyclodextrin, perfume, solvents, soil release polymers, preservatives, antimicrobial agents, chlorine scavengers, anti-shrinkage agents, fabric crisping agents, spotting agents, anti-oxidants, anti-corrosion agents, bodying agents, drape and form control agents, smoothness agents, static control agents, wrinkle control agents, sanitization agents, disinfecting agents, germ control agents, mold control agents, mildew control agents, antiviral agents, anti-microbials, drying agents, stain resistance agents, soil release agents, malodor control agents, fabric refreshing agents, chlorine bleach odor control agents, dye fixatives, dye transfer inhibitors, color maintenance agents, color restoration/rejuvenation agents, anti-fading agents, whiteness enhancers, anti-abrasion agents, wear resistance agents, fabric integrity agents, anti-wear agents, defoamers and anti-foaming agents, rinse aids, UV protection agents, sun fade inhibitors, insect repellents, anti-allergenic agents, enzymes, flame retardants, water proofing agents, fabric comfort agents, water conditioning agents, shrinkage resistance agents, stretch resistance agents, and mixtures thereof. These ingredients are described in further detail in EP 1297101 and in WO 01/85888 and the references cited therein; and in U.S. Pat. Appl. Pub. No. US 2003/0060390, at paragraphs 123-222.

As already specified, the compositions according to the present invention are essentially free of nonionic surfactant. As used herein the term "essentially free" means less than 1%, preferably less than 0.1%, more preferably less than 0.01%, even more preferably alternatively less than 0.001%, alternatively about 0% of the subject compound, material or ingredient, by weight of the fabric care composition.

Product Stability

According to one aspect, the present invention is based upon the surprising discovery that the compositions of the present invention exhibit improved product stability upon prolonged storage. The expression "prolonged storage" means a composition of the present invention is stored for up to 6 months at temperatures up to 43° C.

In the context of the present invention, it has been surprisingly discovered that the presence of hydrophobic esters having a Clog P of greater than 4 in a fabric softening composition comprising a fabric softening active, provides improved product stability of the compositions upon prolonged storage, in comparison to a fabric softening composition comprising a fabric softening active and not comprising such hydrophobic esters having a Clog P of greater than 4. Furthermore, it has been surprisingly discovered that the presence of hydrophobic esters having a Clog P of greater than 4 and a chelant in a fabric softening composition comprising a fabric softening active, provides improved product stability of the compositions upon prolonged storage, in comparison to a fabric softening composition comprising a fabric softening active and hydrophobic esters having a Clog P of greater than 4 but not comprising chelants. Such improved product stability translates into both improved physical stability and improved resistance to shear. Without wishing to be bound by theory, it is believed that the presence of said hydrophobic esters, due to the electrostatic repulsion they induce against water molecules, contribute to move said water away from said fabric softening actives, in particular the diester quaternary ammonium compounds suitable for use herein. As a consequence, premature hydrolysis of said fabric softening actives is more efficiently prevented and improved product stability is achieved. It is also known that premature hydrolysis of fabric softening actives is aggravated by specific factors such as e.g. high temperatures, incorporation of a perfume, and/or low pH of the corresponding composition. Advantageously, the improved product stability at elevated temperature of the compositions according to the present invention is not detrimentally affected by the addition of a perfume.

As already mentioned, conventional liquid fabric softening compositions are generally in the form of dispersed colloidal vesicles/particles of the fabric softening active typically arranged in an onion-type configuration. According to the present invention, it has been surprisingly discovered that the presence of hydrophobic esters having a Clog P of greater than 4 strongly contribute to drive the water molecules out from the vesicles/particles of fabric softening active. Consequently, more condensed vesicles/particles are achieved which in turn allow formulating more concentrated compositions with higher fabric softening active concentration. The compositions according to the present invention lend themselves to the preparation of highly concentrated fabric softening compositions, which allow the formulation of "compact" type formulations.

Resistance to Shear

In another aspect, it has been surprisingly discovered that compositions according to the present invention exhibit improved resistance against shear operations such as mixing, pumping, handling, or shipping.

According to the present invention, it has been surprisingly found that the incorporation of hydrophobic esters having a Clog P of greater than 4 in a fabric softening composition comprising a fabric softening active, provides improved resistance to shear operations. Furthermore, it has been surprisingly found that the incorporation of hydrophobic esters having a Clog P of greater than 4 and a chelant in a fabric softening composition comprising a fabric softening active, provides improved resistance to shear operations compared to fabric softening compositions comprising a fabric softening active and hydrophobic esters having a Clog P of greater than 4 but which do not comprise chelants. In other words, it has been discovered that hydrophobic esters having a Clog P of greater than 4 and chelants act as shear stabilizers for the corresponding softening compositions. This is an important benefit as the fabric softening compositions of the present invention may be subjected to high shear mixing or pumping during e.g. processing without experiencing substantial loss or change in viscosity or physical aspect of the compositions. Furthermore, the compositions according to the present invention exhibit the same benefits when submitted to high shearing operations such as packing, warehouse handling, transportation, shipping, and transit of the corresponding compositions. Without being bound by theory, it is believed that the presence of hydrophobic esters having a Clog P of greater than 4 in the active vesicles increases their flexibility profile. Accordingly, the corresponding vesicles tend to be less detrimentally affected by the shearing operation to which they might be submitted.

Viscosity

Typically, the compositions according to the present invention have a viscosity comprised between 1 mPas and 1000 mPas, preferably between 10 mPas and 750 mPas, more preferably between 10 mPas and 500 mPas, and most preferably between 20 mPas and 300 mPas, when measured with a TA Instruments/Advanced rheometer AR 1000 at a temperature of 20° C. with a gap setting of 200 microns, and at a shear rate of 20 $s^{-1}$, or when measured at 25° C. with a Brookfield® viscometer using a No. 2 spindle at 60 rpm.

The fabric care compositions of the present invention can be used in a so-called rinse process. Typically the compositions of the present invention are added during the rinse cycle of an automatic laundry machine. One aspect of the invention provides dosing the composition of the present invention during the rinse cycle of automatic laundry washing machine. Another aspect of the invention provides for a kit comprising a composition of the present invention and optionally instructions for use.

Process of Manufacturing a Fabric Softening Composition

In another embodiment, the present invention relates to a process of manufacturing a fabric softening composition comprising a fabric softening active, wherein the process comprises the step of pre-mixing the fabric softening active with a hydrophobic ester having a Clog P of greater than 4.

Typically, the hydrophobic ester having a Clog P of greater than 4 is incorporated into a base matrix comprising the fabric softening active so as to form a pre-mix composition. Chelants and other optional ingredients such as e.g. perfumes are generally added in a second step into the previously formed pre-mix composition under high-shear mixing.

Without wishing to be bound by theory, it is believed that the formation of the pre-mix composition helps in achieving improved product stability at elevated temperature of the resulting fabric softening composition.

In a preferred execution of the process of the present invention, the hydrophobic ester has a Clog P of greater than 5, preferably greater than 6, more preferably greater than 7, and most preferably greater than 8. In more preferred execution, the hydrophobic ester is selected from the group consisting of glycerol tricaprylate, isopropyl caprylate, ethyl hexyl caprylate, isopropyl myristate, dioctyl adipate, glycol diesters of C8-C22 fatty acids and mixtures thereof, and the chelant is selected from the group consisting of the penta sodium salt of Diethylene Triamine Pentaacetic acid (DTPA), the mono sodium salt of 1-HydroxyEthane-1,1-DiPhosphonic acid (HEDP), ethylenediaminetetraacetic acid (EDTA), S,S-Ethylenediamine disuccinic acid (EDDS), Catechol 2,4-disulfonate (commercially available as Tiron®), diethylenetriamine-penta methylene phosphoric acid (DTPMP), dipicolinic acid and salts and/or acids thereof, and mixtures thereof.

In an even more preferred execution, the hydrophobic ester is glycerol tricaprylate and the chelant is the penta sodium salt of Diethylene Triamine Pentaacetic acid (DTPA).

In another embodiment, the hydrophobic ester is glycerol tricaprylate and the chelant is the mono sodium salt of 1-HydroxyEthane-1,1-DiPhosphonic acid (HEDP).

According to another aspect of the present invention, said fabric softening composition is essentially free of nonionic surfactant.

Method of Improving Product Stability

In another embodiment of the present invention, it is provided a method of improving the product stability upon prolonged storage at elevated temperatures of a fabric softening composition comprising a fabric softening active, the method comprising the first step of incorporating into the composition a hydrophobic ester having a Clog P of greater than 4 to form a pre-mix composition, followed by a second step of incorporating a chelant and other optional ingredients into the pre-mix composition.

In a preferred execution of the method of the present invention, the hydrophobic ester has a Clog P of greater than 5, preferably greater than 6, more preferably greater than 8, and most preferably greater than 10. In an even more preferred execution, the hydrophobic ester is selected from the group consisting of glycerol tricaprylate, isopropyl caprylate, ethyl hexyl caprylate, isopropyl myristate, dioctyl adipate, glycol diesters of C8-C22 fatty acids and mixtures thereof, and the chelant is selected from the group consisting of the penta sodium salt of Diethylene Triamine Pentaacetic acid (DTPA), the mono sodium salt of 1-HydroxyEthane-1,1-DiPhosphonic acid (HEDP), ethylenediaminetetraacetic acid (EDTA), S,S-Ethylenediamine disuccinic acid (EDDS), Catechol 2,4-disulfonate (commercially available as Tiron®), diethylenetriamine-penta methylene phosphoric acid (DTPMP), dipicolinic acid and salts and/or acids thereof, and mixtures thereof.

In an even more preferred execution, the hydrophobic ester is glycerol tricaprylate and the chelant is the penta sodium salt of Diethylene Triamine Pentaacetic acid (DTPA).

In another embodiment, the hydrophobic ester is glycerol tricaprylate and the chelant is the mono sodium salt of 1-HydroxyEthane-1,1-DiPhosphonic acid (HEDP).

According to another aspect of the present invention, said fabric softening composition is essentially free of nonionic surfactant.

Method of Improving Resistance to Shear

The present invention further encompasses a method of improving resistance to shear of a fabric softening composition comprising a fabric softening active, the method comprising the first step of incorporating into the composition a hydrophobic ester having a Clog P of greater than 4 to form a pre-mix composition, followed by a second step of incorporating a chelant and other optional ingredients into the pre-mix composition.

According to the present invention, it has indeed been surprisingly found that the incorporation of hydrophobic esters having a Clog P of greater than 4 in a fabric softening composition comprising a fabric softening active, provides improved resistance to shear operations. Accordingly, the fabric softening compositions of the present invention may be subjected to e.g. high shear mixing or pumping during processing without experiencing substantial loss or change in viscosity or physical aspect of the compositions.

In a preferred execution, the hydrophobic ester is selected from the group consisting of glycerol tricaprylate, isopropyl caprylate, ethyl hexyl caprylate, isopropyl myristate, dioctyl adipate, glycol diesters of C8-C22 fatty acids and mixtures thereof, and the chelant is selected from the group consisting of the penta sodium salt of Diethylene Triamine Pentaacetic acid (DTPA), the mono sodium salt of 1-HydroxyEthane-1,1-DiPhosphonic acid (HEDP), ethylenediaminetetraacetic acid (EDTA), S,S-Ethylenediamine disuccinic acid (EDDS), Catechol 2,4-disulfonate (commercially available as Tiron®), diethylenetriamine-penta methylene phosphoric acid (DTPMP), dipicolinic acid and salts and/or acids thereof, and mixtures thereof. In an even more preferred execution, the hydrophobic ester is glycerol tricaprylate and the chelant is the penta sodium salt of Diethylene Triamine Pentaacetic acid (DTPA).

In another embodiment, the hydrophobic ester is glycerol tricaprylate and the chelant is the mono sodium salt of 1-HydroxyEthane-1,1-DiPhosphonic acid (HEDP).

According to another aspect of the present invention, said fabric softening composition is essentially free of nonionic surfactant.

Method of Softening Fabric

In yet a further embodiment, the present invention is directed to a method of softening fabric, the method comprising the step of dosing in a rinse cycle of automatic laundry washing machine a composition according to the present invention.

EXAMPLES

These following compositions were made comprising the listed ingredients in the listed proportions (weight %). The examples herein are met to exemplify the present invention but are not necessarily used to limit or otherwise define the scope of the present invention. Compositions 1 and 2 are according to the present invention, whereas compositions A, B, C and D are comparative examples.

| Ingredients: | COMPOSITIONS | | | | | |
|---|---|---|---|---|---|---|
| (% by weight) | A | B | 1 | C | D | 2 |
| Softener[a] | 12 | 12 | 12 | 6 | 6 | 6 |
| Glycerol tricaprylate | 0.5 | — | 0.5 | 0.3 | — | 0.3 |
| DTPA | — | 0.05 | 0.05 | — | 0.05 | 0.05 |
| Preservative[b] | 0.0075 | 0.0075 | 0.0075 | 0.0075 | 0.0075 | 0.0075 |
| Formic Acid | 0.025 | 0.025 | 0.025 | 0.025 | 0.025 | 0.025 |
| Perfume | 4% | 4% | 4% | 2% | 2% | 2% |
| Water + Minors | balance | balance | balance | balance | balance | balance |

[a]DiEthyl Ester DiMethyl Ammonium Chloride in a 15% isoproponal solution, supplied by Degussa under the tradename Rewoquat V3282.
[b]Benzo-iso-thiazoline,, supplied by Avecia under the tradename Proxel GXL.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric softening composition comprising:

1) from about 1% to 25% by weight of a fabric softening active comprising a compound or a mixture of compounds selected from the group consisting of compounds having the following formula:

$$\{R_{4-m}—N^{+}-[(CH_2)_n—Y—R^1]_m\}X- \quad (a)$$

wherein each R substituent is either hydrogen, a short chain $C_1$-$C_6$ alkyl, poly ($C_{2-3}$ alkoxy), benzyl, or mixtures thereof; each m is 2 or 3; each n is from 1 to about 4; each Y is —O— (O)C— or —C(O)—O; the sum of carbons in each $R^1$ is $C_{11}$-$C_{21}$, with each $R^1$ being a hydrocarbyl, or substituted hydrocarbyl group; and $X^-$ can be any softener-compatible anion; or $$\{R_{4-m}—N^{+}-[(CH_2)_n—Y—R^1]_m\}X- \quad (b)$$

wherein each R substituent is either hydrogen, a short chain $C_1$-$C_6$ alkyl, poly ($C_{2-3}$ alkoxy), benzyl, or mixtures thereof; each m is 2 or 3; each n is from 1 to about 4; each Y is $CH_2$, or —NR—C(O)—, or —C(O)—NR— and it is acceptable for each Y to be the same or different; the sum of carbons in each $R^1$, minus (n+1) when Y is $CH_2$, is $C_{12}$-$C_{22}$, with each $R^1$ being a hydrocarbyl, or substituted hydrocarbyl group; and $X^-$ can be any softener-compatible anion; or (c)

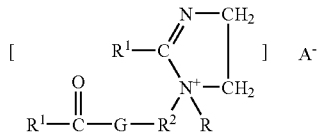

wherein each R, $R^1$, and $A^-$ have the definitions given above; each $R^2$ is a $C_1$-$C_6$ alkylene group, and G is an oxygen atom or an —NR— group;

2) from about 0.01% to about 10% by weight of a hydrophobic ester having a Clog P of greater than 4, wherein the hydrophobic ester is glycerol tricaprylate; and 3) from about 0.001% to 5% by weight of a chelant, wherein the chelant is the pentasodium salt of Diethylene Triamine Pentaacetic acid (DTPA), wherein said composition is essentially free of a nonionic surfactant.

2. A composition according to claim 1, wherein fabric softener active is selected form the group consisting of N,N-di(hydrogenated tallowoyloxyethyl)-N,N-dimethylammonium chloride; N,N-di(tallowoyloxyethyl)-N,N-dimethylammonium chloride; Di-hydrogenated tallow dimethyl ammonium chloride or ditallowdimethyl ammonium chloride; 1-methyl-1-tallowylamidoethyl-2-oleylimidazolinium methylsulfate; 1-methyl-1-oleylamidoethyl-2-oleylimidazolinium methylsulfate; mixture thereof.

3. A fabric softening composition according to any claims 1, wherein the viscosity of said composition is comprised between 1 mPas and 1000 mPas when measured with a TA Instruments/Advanced rheometer AR 1000 at a temperature of 20° C. with a gap setting of 200 microns, and at a shear rate of 20 $s^{-1}$.

4. A process of manufacturing the fabric softening composition of claim 1 comprising;

a first step of pre-mixing said fabric softening active with said hydrophobic ester to form a pre-mix composition;

a second step of mixing said chelant and other optional ingredients to the pre-mix composition.

5. A method of softening fabric comprising the step of dosing in a rinse step of a washing process a composition according to claim 1.

* * * * *

UNITED STATES PATENT AND TRADEMARK OFFICE

CERTIFICATE OF CORRECTION

PATENT NO. : 7,858,575 B2
APPLICATION NO. : 12/255928
DATED : December 28, 2010
INVENTOR(S) : DeBlock It is certified that error appears in the above-identified patent and that said Letters Patent is hereby corrected as shown below:

Column 5

Line 50, Delete "R" and insert --$R^4$--.

Column 14

Line 17, Delete "any claims" and insert --claim--.

Signed and Sealed this
Twenty-seventh Day of December, 2011

David J. Kappos

David J. Kappos
*Director of the United States Patent and Trademark Office*